US010301710B2

(12) United States Patent
Fischer et al.

(10) Patent No.: US 10,301,710 B2
(45) Date of Patent: May 28, 2019

(54) ALUMINUM ALLOY THAT IS NOT SENSITIVE TO QUENCHING, AS WELL AS METHOD FOR THE PRODUCTION OF A SEMI-FINISHED PRODUCT

(71) Applicant: Otto Fuchs KG, Meinerzhagen (DE)

(72) Inventors: Gernot Fischer, Meinerzhagen (DE); Gregor Terlinde, Meinerzhagen (DE); Matthias Hilpert, Meinerzhagen (DE)

(73) Assignee: Otto Fuchs KG, Meinerzhagen (DE)

( * ) Notice: Subject to any disclaimer, the term of this patent is extended or adjusted under 35 U.S.C. 154(b) by 0 days.

(21) Appl. No.: 14/861,853

(22) Filed: Sep. 22, 2015

(65) Prior Publication Data

US 2016/0010195 A1 Jan. 14, 2016

Related U.S. Application Data

(63) Continuation of application No. 14/101,036, filed on Dec. 9, 2013, now abandoned, which is a continuation of application No. 13/136,301, filed on Jul. 28, 2011, now abandoned, which is a continuation of application No. 12/859,757, filed on Aug. 19, 2010, now abandoned, which is a continuation of application No. 11/334,813, filed on Jan. 18, 2006, now abandoned.

(30) Foreign Application Priority Data

Jan. 19, 2005 (DE) ..... 10 2005 002 390

(51) Int. Cl.

| | |
|---|---|
| ***C22C 1/06*** | (2006.01) |
| ***C22F 1/053*** | (2006.01) |
| ***C22C 21/10*** | (2006.01) |
| ***C22F 1/00*** | (2006.01) |

(52) U.S. Cl.

CPC ..... *C22F 1/053* (2013.01); *C22C 1/06* (2013.01); *C22C 21/10* (2013.01); *C22F 1/002* (2013.01); *Y10T 428/12* (2015.01)

(58) Field of Classification Search

CPC ..... C22C 1/06; C22C 1/10; C22F 1/002
See application file for complete search history.

(56) References Cited

U.S. PATENT DOCUMENTS

| | | | |
|---|---|---|---|
| 3,743,549 | A | 7/1973 | Di Russo et al. |
| 3,794,531 | A | 2/1974 | Markworth et al. |
| 3,943,039 | A | 3/1976 | Wittrock |
| 3,945,861 | A | 3/1976 | Anderson et al. |
| 4,049,474 | A | 9/1977 | Zakharov et al. |
| 4,063,936 | A | 12/1977 | Nagase et al. |
| 4,345,951 | A | 8/1982 | Coupry et al. |
| 4,629,517 | A | 12/1986 | Lifka et al. |
| 4,747,890 | A | 5/1988 | Meyer |
| 4,828,631 | A | 5/1989 | Ponchel et al. |
| 4,830,826 | A | 5/1989 | Kawakatsui Ichiro |
| 4,863,528 | A | 9/1989 | Brown et al. |
| 4,954,188 | A | 9/1990 | Ponchel et al. |
| 4,995,920 | A | 2/1991 | Faure et al. |
| 5,047,092 | A | 9/1991 | Faure |
| 5,055,257 | A | 10/1991 | Chakrabarti et al. |
| 5,110,372 | A | 5/1992 | Faure |
| 5,221,377 | A | 6/1993 | Hunt, Jr. et al. |
| 5,277,719 | A | 1/1994 | Kuhlman et al. |
| 5,312,498 | A | 5/1994 | Anderson |
| 5,560,789 | A | 10/1996 | Sainfort et al. |
| 5,620,652 | A | 4/1997 | Tack et al. |
| 6,027,582 | A | 2/2000 | Shahani et al. |
| 6,048,415 | A | 4/2000 | Nakai et al. |
| 6,565,684 | B2 | 5/2003 | Sigli et al. |
| 6,726,878 | B1 | 4/2004 | Flidlyander et al. |
| 6,743,308 | B2 | 6/2004 | Tanaka et al. |
| 6,790,407 | B2 | 9/2004 | Fridlyander et al. |
| 6,972,110 | B2 | 12/2005 | Chakrabarti et al. |
| 7,520,945 | B2 | 4/2009 | Dumont et al. |
| 7,550,110 | B2 | 6/2009 | Warner et al. |
| 7,780,802 | B2 | 8/2010 | Dif et al. |
| 2002/0150498 | A1 | 10/2002 | Chakrabarti et al. |

(Continued)

FOREIGN PATENT DOCUMENTS

| | | |
|---|---|---|
| AT | 384744 | 12/1987 |
| AU | 670114 | 7/1996 |

(Continued)

OTHER PUBLICATIONS

Jack W. Bray, "Physical Metallurgy" in "Aluminum Mill and Engineered Wrought Products," ASM Handbooks Online, vol. 2, 2002, pp. 1-34.

William F. Brown, Jr., Technical Editor, "Nonferrous Alloys," in "Aerospace Structural Metals Handbook, 1997 Edition," vol. 3, p. 5.

Jean-Remi Butruille and Dominique Fenot, Opposition filed by Alcan France S.A.S., "Opposition au brevet european No. 1 683 882 B1 (demande No. 05111026.0) 'Alliage d'Aluminium avec sensibilite a la trempe reduite et procede de fabrication d'un produit demi-final lors de cet alliage,'" Jul. 7, 2008, pp. 1-13, Lyon, France. (English translation below.).

(Continued)

*Primary Examiner* — Christopher S Kessler
(74) *Attorney, Agent, or Firm* — Collard & Roe, P.C.

(57) ABSTRACT

An aluminum alloy that is not sensitive to quenching, for the production of high-strength forged pieces that are low in inherent tension, and high-strength extruded and rolled products, consisting of: 7.0-10.5 wt. % zinc, 1.0-2.5 wt. % magnesium, 0.1-1.15 wt. % copper, 0.06-0.25 wt. % zirconium, 0.02-0.15 wt. % titanium, at most 0.5 wt. % manganese, at most 0.6 wt. % silver, at most 0.10 wt. % silicon, at most 0.10 wt. % iron, at most 0.04 wt. % chrome, and at least one element selected from the group consisting of: hafnium, scandium, strontium and/or vanadium with a summary content of at most 1.0 wt. %. The alloy can also contain contaminants at proportions of at most 0.05 wt. % per element and a total proportion of at most 0.15 wt. %, wherein the remaining component includes aluminum.

18 Claims, 2 Drawing Sheets

(56) References Cited

U.S. PATENT DOCUMENTS

| | | | |
|---|---|---|---|
| 2002/0162609 | A1 | 11/2002 | Warner |
| 2003/0213537 | A1 | 11/2003 | Cho |
| 2003/0219353 | A1 | 11/2003 | Warner et al. |
| 2004/0099352 | A1 | 5/2004 | Gheorghe et al. |
| 2004/0136862 | A1 | 7/2004 | Bray et al. |
| 2005/0000610 | A1 | 1/2005 | Huber |
| 2005/0006010 | A1 | 1/2005 | Benedictus et al. |
| 2005/0023075 | A1 | 2/2005 | Schmaeman |
| 2005/0034794 | A1 | 2/2005 | Benedictus et al. |
| 2005/0056353 | A1 | 3/2005 | Brooks et al. |
| 2005/0058568 | A1 | 3/2005 | Boselli et al. |
| 2005/0072497 | A1 | 4/2005 | Eberl et al. |
| 2005/0087266 | A1 | 4/2005 | Makino |
| 2005/0150578 | A1 | 7/2005 | Bes et al. |
| 2005/0150579 | A1 | 7/2005 | Chakrabarti et al. |
| 2005/0189044 | A1 | 9/2005 | Benedictus et al. |
| 2005/0238528 | A1 | 10/2005 | Lin et al. |
| 2005/0257865 | A1 | 11/2005 | Chakrabarti et al. |
| 2006/0096676 | A1 | 5/2006 | Hollrigl et al. |
| 2006/0157172 | A1 | 7/2006 | Fischer et al. |
| 2006/0182650 | A1 | 8/2006 | Eberl et al. |
| 2007/0243097 | A1 | 10/2007 | Sarrazin et al. |
| 2008/0056932 | A1 | 3/2008 | Cho et al. |
| 2009/0269608 | A1 | 10/2009 | Benedictus et al. |
| 2011/0008202 | A1 | 1/2011 | Fischer et al. |

FOREIGN PATENT DOCUMENTS

| | | | |
|---|---|---|---|
| CH | 682326 | A5 | 8/1993 |
| DE | 2 052 000 | | 4/1972 |
| DE | 32 47873 | C2 | 7/1983 |
| DE | 10 392 805 | T5 | 6/2005 |
| DE | 11 2004 000 596 | T5 | 3/2006 |
| DE | 11 2004 000 603 | T5 | 3/2006 |
| EP | 0 020 505 | B | 1/1981 |
| EP | 0 081 441 | B | 6/1983 |
| EP | 0 202 044 | B | 11/1986 |
| EP | 0 257 167 | B | 3/1988 |
| EP | 0 368 005 | B | 5/1990 |
| EP | 0 375 571 | B | 6/1990 |
| EP | 0 377 779 | B | 7/1990 |
| EP | 0 391 815 | B | 10/1990 |
| EP | 0 462 055 | A | 12/1991 |
| EP | 0 587 274 | A | 3/1994 |
| EP | 0 589 807 | B | 3/1994 |
| EP | 0 670 377 | A | 9/1995 |
| EP | 0 694 084 | B | 1/1996 |
| EP | 0 876 514 | B | 11/1998 |
| EP | 0 882 610 | B | 12/1998 |
| EP | 1 000 179 | B | 5/2000 |
| EP | 1 127 952 | A | 8/2001 |
| EP | 1 158 068 | A | 11/2001 |
| EP | 1 170 394 | B | 1/2002 |
| EP | 1 241 275 | A | 9/2002 |
| EP | 1 306 455 | A | 5/2003 |
| EP | 1 366 377 | A | 12/2003 |
| EP | 1 464 719 | A | 10/2004 |
| EP | 1 544 315 | A | 6/2005 |
| EP | 1 544 316 | A | 6/2005 |
| EP | 1 683 882 | A | 7/2006 |
| FR | 2 640 644 | A | 6/1990 |
| FR | 2 695 942 | A | 3/1994 |
| FR | 2 716 896 | A | 9/1995 |
| FR | 2 744 136 | A | 8/1997 |
| FR | 2 762 329 | | 10/1998 |
| FR | 2 805 282 | B | 8/2001 |
| FR | 2 820 438 | A | 8/2002 |
| FR | 2 838 135 | A | 10/2003 |
| FR | 2 838 136 | A | 10/2003 |
| FR | 2 841 264 | A | 12/2003 |
| FR | 2 846 669 | A | 5/2004 |
| FR | 2 853 666 | A | 10/2004 |
| FR | 2 853 667 | A | 10/2004 |
| FR | 2 872 172 | A | 12/2005 |
| GB | 2 402 943 | A | 12/2004 |
| GB | 2 415 202 | A | 12/2005 |
| GB | 2 415 203 | B | 1/2007 |
| IT | 1130700 | B | 6/1986 |
| JP | 58 161747 | | 9/1983 |
| JP | 08295976 | | 11/1996 |
| WO | WO1996/10099 | | 4/1996 |
| WO | WO1997/27343 | | 7/1997 |
| WO | WO2002/010468 | A | 2/2002 |
| WO | WO2002/052053 | | 7/2002 |
| WO | WO2002/073242 | | 9/2002 |
| WO | WO2002/097148 | | 12/2002 |
| WO | WO2003/085145 | | 10/2003 |
| WO | WO2003/085146 | | 10/2003 |
| WO | WO2004/044256 | | 5/2004 |
| WO | WO2004/046402 | | 6/2004 |
| WO | WO2004/046403 | | 6/2004 |
| WO | WO2004/063407 | | 7/2004 |
| WO | WO2004/090185 | | 10/2004 |
| WO | WO2005/001149 | | 1/2005 |
| WO | WO2005/003398 | | 1/2005 |
| WO | WO2005/021209 | | 3/2005 |
| WO | WO2005/040440 | | 5/2005 |
| WO | WO2005/106057 | | 11/2005 |
| WO | WO2005/106058 | | 11/2005 |
| WO | WO2006/010817 | | 2/2006 |

OTHER PUBLICATIONS

Jean-Remi Butruille and Dominique Fenot, Opposition filed by Alcan France S.A.S., "Einspruch gegen die Europaeische Patentschrift No. 1 683 882 B1 (Anmeldung No. 05111026.0) 'Abschreckunempfindliche Aluminiumlegierung sowie Verfahren zum Herstellen eines Halbzeugs aus dieser Legierung,' der Otto Fuchs KG" Jul. 8, 2008, pp. 1-19, Munich, Germany. (English translation below.).

Jean-Remi Butruille and Dominique Fenot, Opposition filed by Alcan France S.A.S., Opposition against European Patent No. 1 683 882 B1 (application No. 05111026.0) of Otto Fuchs KG, "Alluminum alloy insensitive against cooling and method for producing of a semi-finished product out of alloy," Jul. 7, 2008, pp. 1-9, Lyon, France. French and German versions shown separately.

Jean-Remi Butruille and Dominique Fenot, Opposition against European Patent No. 1 683 882 B1 (Application No. 05111026.9), "Aluminum alloy with sensitivity at reduced tempering and procedure of manufacturing a semi-final product of that alloy," Oct. 1, 2009, Lyon, France; English translation pp. 1-10 and exhibits and French original document without exhibits. 37 pages.

Jean-Remi Butruille and Dominique Fenot, Opposition against European No. 1 683 882 B1 (Application No. 05111026.9), "Aluminum alloy with sensitivity at reduced tempering and procedure of manufacturing a semi-final product of that alloy," Oct. 23, 2009, Lyon, France; English translation pp. 1-3 and French original document pp. 3-6.

"Chemical Composition Limits" published in "International Alloy Designations and Chemical Composition Limits for Wrought Aluminum and Wrought Aluminum Alloys," The Aluminum Association, Washington, D.C., Oct. 2002, p. 8.

J.R. Davis, Editor, "ASM Specialty Handbook Aluminum and Aluminum Alloys," ASM International and the Materials Information Society, 1993, pp. 41, 45, and 46.

J. R. Davis, Editor, "ASM Specialty Handbook Aluminum and Aluminum Alloys," ASM International and the Materials Information Society, 1993, pp. 265-274.

Evaluation of the temper (quench) sensitivity for an alloy 7046 , 2 pages.

G. Fischer, F.W. Lynker and M. Markworth, "Eine abschreckunempfindliche AlZnMgCu-Legierung mit Zusaetzen von Chrom, Zirkon und Silber," 1972, Aluminum, pp. 413-418. Condensed Version in English A Non-Quench Sensitive AlZnMgCu-Alloy with Additions of Chromium, Zironium and Silver on p. 418.

J.E. Hatch, Editor, "Aluminum, Properties and Physical Metallurgy," American Society for Metals, 1984, p. 165.

(56) References Cited

OTHER PUBLICATIONS

H.A. Holl, "Investigations into the Possibility of Reducing Quench-Sensitivity in High-Strength Al-Zn-Mg-Cu Alloys," Journal of the Institute of Metals, vol. 97, 1969, pp. 200-205.
H.J. Kolkmann, W.G.J.'t Hart and L. Schara, "Quench Sensitivity of Airframe Aluminum Alloys," 1988, Materials Department, National Aerospace Laboratory NLR, p. 597-602.
R. J. Livak and J.M. Papazian, "Effects of Copper on Precipitation and Quench Sensitivity of AlZnMg Alloys," Pergamon Press Ltd., U.S.A., Scripta Metallurgica, vol. 18, 1984, pp. 483-488.
M. Markworth, "Kupferhaltige AlZnMg-Knetlegierungen—Eigenschaften und Entwicklungstendenzen," Aluminum, Nov. 1972, pp. 724-733, Meinerzhagen, Germany. English abstract is next item listed.
M. Markworth, Summary in English of "AlZnMg—Knead Alloys with Copper Contents—Features and Development Tendencies," Aluminum, Nov. 1972, 1 Page, Meinerzhagen, Germany.
"Minutes of Oral Proceedings with the Opposition Division," Nov. 25, 2009; English translation pp. 1-15 and German original document. 54 pages.
Kent R. Van Horn,editor, "Aluminum," vol. III—Fabrication and Finishing, "Preface to vol. Three," 1967, American Society for Metals, Metals Park, Ohio, pp. 21-25.

ALUMINUM ALLOY THAT IS NOT SENSITIVE TO QUENCHING, AS WELL AS METHOD FOR THE PRODUCTION OF A SEMI-FINISHED PRODUCT

CROSS REFERENCE TO RELATED APPLICATIONS

This application is a continuation application of Ser. No. 14/101,036 filed on Dec. 9, 2013 which is a continuation application of U.S. patent application Ser. No. 13/136,301 filed on Jul. 28, 2011 which is a continuation application of U.S. patent application Ser. No. 12/859,757 filed Aug. 19, 2010, which is a continuation of U.S. patent application Ser. No. 11/334,813 filed Jan. 18, 2006, which further claims priority from German Application Serial No. 10 2005 002 390.8 filed on Jan. 19, 2005, wherein the disclosures of each of the above applications are hereby incorporated herein by reference in their entirety.

BACKGROUND OF THE INVENTION

The invention relates to an aluminum alloy that is not sensitive to quenching, and which is used for the production of high-strength forged pieces low in inherent tension, and high-strength extruded and rolled products. Furthermore, the invention relates to a method for the production of a semi-finished product from such an aluminum alloy.

High-strength aluminum alloys are needed for the aeronautics and space industry, in particular, bearing hull, wing, and chassis parts which demonstrate high strength both under static stress and under dynamic stress. The required strength properties can be achieved, in the case of the aforementioned semi-finished products, by using alloys from the 7000 group (7xxx alloys), in accordance with the classification of aluminum alloys prepared by the Aluminum Association (AA).

Die-forged pieces for parts that are subject to great stress in the aeronautics and space industry, for example, parts made from the alloys AA 7075, AA 7175, AA 7475 and, particularly preferably, from the alloys AA 7049 and AA 7050, in America, and made from the alloys AA 7010, AA 7049A, and AA 7050A in Europe.

A high-strength aluminum alloy of the aforementioned type is known from WO 02/052053 A1, or U.S. Pat. No. 6,972,110 issued on Dec. 6, 2005 to Chakrabarti et al., the disclosure of which is hereby incorporated herein by reference. That reference discloses an alloy having an increased zinc content as compared with earlier alloys of the same type, coupled with a reduced copper and magnesium content. The copper and magnesium content in the case of this previously known alloy amounts to less than 3.5%, in total. The copper content itself is indicated as being 1.2-2.2 wt.-%, preferably 1.6-2.2 wt.-%. In addition to the elements zinc, magnesium, and copper, this previously known alloy necessarily contains one or more elements from the group zirconium, scandium, and hafnium, with maximum proportions of 0.4 wt.-% zirconium, 0.4 wt.-% scandium, and 0.3 wt.-% hafnium.

The semi-finished products should be subjected to a special heat treatment to produce the semi-finished products from one of the aforementioned alloys. These products can be in the form of forged pieces, wherein with this heat treatment, the extruded profiles, or the rolled sheets are treated to have the desired strength. This treatment includes quenching from solution heat temperature, in most cases combined with subsequent cold forming at medium thickness values of more than 50 mm. The cold forming serves to reduce the tensions induced during quenching. The step of cold forming can occur by means of cold upsetting or also by means of stretching the semi-finished product, typically by 1-3%. The semi-finished products produced should be as low in inherent tension as possible, to minimize any undesirable drawing during further processing. In addition, the semi-finished products and also the finished parts produced from them should be low in inherent tension, to give the designer the possibility of utilizing the entire material potential. For this reason, the method steps to be used for the production of parts for aeronautics and space technology from the alloys AA 7050 as well as AA 7010, and also the maximum thickness of the semi-finished products used for the production of the parts, are standardized and/or prescribed. The maximal permissible thickness is 200 mm and presupposes that after quenching, the semi-finished product is necessarily subjected to a cold forming step, for the reasons indicated above. With extruded and rolled products, cold forming can be achieved in a fairly simple manner, because of the geometry, which is generally simple, via stretching in the longitudinal direction. With geometrically complicated forged pieces, on the other hand, it is only possible to achieve a uniformly high degree of upsetting with great effort and expense, if it is even possible at all. In the course of designing larger aircraft, larger and larger and, in particular, thicker and thicker forged parts are constantly required.

SUMMARY OF THE INVENTION

The invention relates to a high-strength aluminum alloy that is not sensitive to quenching, having the same or better strength properties as the alloys AA 7010 and AA 7050 which, at the same time, has lower inherent tensions due to quenching after cold forming, and from which semi-finished products having a medium thickness can be produced having great strength and fracture resistance, without the need for a cold forming step to reduce inherent tensions induced by quenching.

The invention further relates to a method for the production of a semi-finished product having the desired properties from this alloy.

A high-strength aluminum alloy that is not sensitive to quenching according to an embodiment of the invention, comprises an alloy consisting of: 7.0-10.5 wt. % zinc, 1.0-2.5 wt. % magnesium, 0.1-1.15 wt. % copper, 0.06-0.25 wt. % zirconium, 0.02-0.15 wt. % titanium, at most 0.5 wt. % manganese, at most 0.6 wt. % silver, at most 0.10 wt. % silicon, at most 0.10 wt. % iron, at most 0.04 wt. % chrome, and at least one element selected from the group consisting of: hafnium, scandium, strontium and/or vanadium with a summary content of at most 1.0 wt. %. The alloy can also contain contaminants at proportions of at most 0.05 wt. % per element and a total proportion of at most 0.15 wt. %, wherein the remaining component includes aluminum. In addition, the sum of the alloy elements zinc and magnesium and copper is at least 9 wt. %.

The invention can also relate to a process for treating the above alloy. That process can include a series of steps including hot forming a plurality of homogenized bars via forging, extrusion and/or rolling in the temperature range of 350-440 degrees C. Next there can be a step of solution heat treating of a hot-formed semi-finished product at temperatures that are sufficiently high to bring the alloy elements necessary for hardening into solution uniformly distributed in the structure, preferably at 465-500 degrees C. Next, there can be the step of quenching of the solution heat treated semi-finished products in water, in a water/glycol mixture, or in a salt mixture at temperatures between 100 degrees C. and 170 degrees C. Next there can be the step of cold forming of the quenched semi-finished product to reduce the inherent tensions that occurred during quenching in the quenching medium. Next there can be the step of artificial aging of the quenched semi-finished product, in at least one stage, whereby the heating rates, holding times, and temperatures are adjusted for optimization of the properties.

The terms used within the scope of these explanations with regard to thickness are defined as follows: Semi-finished products having a medium thickness have temper hardening thickness values of 50-180 mm. Semi-finished products having a greater thickness have a temper hardening thickness of >180 mm.

Even semi-finished products having a thickness of more than 200 mm, particularly of 250 mm or more can be produced with the alloy according to the invention that is not sensitive to quenching, having the desired great static and dynamic strength properties and, at the same time, good fracture resistance and good stress crack corrosion behavior. Only at these greater thickness values is a cold forming step carried out to reduce quenching-induced inherent stresses, for practical reasons.

Furthermore, for medium thickness values, semi-finished products produced from the alloy can be mildly cooled, for example in a glycol/water mixture, without any noteworthy negative influence on the very good material properties, after subsequent warm settling. For this reason, the step of cold forming is not necessary for medium thickness values, since the inherent stresses induced with the mild cooling are non-critically low. Therefore it is possible to produce semi-finished products in the medium thickness range with this alloy, in a simple and inexpensive manner, namely without a cold-forming step that would otherwise be necessary.

The advantageous properties of the alloy as described above can also be utilized to simplify the production process of a part for the production of which a semi-finished product having a greater starting thickness is required, and which part has a medium thickness after being processed. Such a semi-finished product having a greater thickness, for example a forged one, is pre-processed by cutting, after the step of hot forming. The pre-processing is designed so that the semi-finished product, which will then be quenched within the course of hot forming, undergoes a reduction in thickness. This reduction in thickness is necessary for the production of the finished part, in any case, wherein the pre-processed semi-finished product can be subjected to heat treatment with mild quenching (glycol/water mixture), without performing a cold forming step that is otherwise necessary for greater thickness values.

Using an alloy according to an embodiment of the invention, semi-finished products having a medium thickness can therefore be quenched in mild manner, by means of glycol/water mixtures. With semi-finished products having a greater thickness, such mild quenching is not practical because of the minimum cooling speed that is required. Accordingly, semi-finished products having a greater thickness are quenched in water. As a result of this, these semi-finished products are subsequently subjected to cold forming, for example upsetting or stretching by 1-5%.

The aforementioned properties of the semi-finished product produced from this alloy, as mentioned above, are unexpected, since contrary to the default values that result from the state of the art, the copper content is clearly lower than was the case for previously known high-strength aluminum alloys. According to a preferred exemplary embodiment, the copper content is only 0.8-1.1 wt. %. At this value, the copper content is only about 50% of the preferred copper content of the aluminum alloys known from WO 02/052053 A1 or U.S. Pat. No. 6,972,110. It is surprising that very high strength values are achieved despite this. It is assumed that these properties are based on the balanced composition of the alloy components, which also includes the relative high zinc content values and the magnesium content that is adapted to this. In the balanced composition of the alloy elements, which are only allowed in narrow limits, the sum of the elements magnesium, copper, and zinc are at least 9 wt. %. It has been shown that the desired strength properties can only be achieved if the elements magnesium, copper, and zinc in total are more than 9 wt. %. This characteristic of the alloy is a measure of the fact that the products have the desired strength properties. This rule also determines the heat treatability of the semi-finished products produced with the alloy.

Particularly great static and dynamic strength properties and particular non-sensitivity to quenching are obtained, along with simultaneous great fracture resistance, if the copper content is 0.8-1.1 wt. % and the magnesium content is 1.6-1.8 wt. %. This corresponds to a zinc:magnesium ratio of 4.4-5.2. Thus, the copper content clearly lies below the maximal solubility for copper in the presence of the aforementioned magnesium content. This has the result that the proportion of insoluble phases that contain copper is very low, even taking into consideration the other alloy elements and accompanying elements. This directly results in an improvement of the dynamic properties and the fracture resistance.

To further increase the strength of the alloy, it can be advantageous to add silver. For economic reasons, the content will be limited to 0.2-0.7 wt. %, particularly to 0.20-0.40 wt. %.

The manganese content of the alloy was limited to a maximum 0.5 wt. %. Manganese precipitates in the form of finely distributed manganese aluminides, which can furthermore contain part of the iron present in the alloy as a contaminant, in Al—Zn—Cu—Mg alloys, during the homogenization of the extruded bars. These manganese aluminides are helpful in controlling recrystallization of the structure during heat treatment of the formed semi-finished product. Experience has shown that the ability to through-harden an Al—Zn—Cu—Mg alloy decreases with an increasing manganese content. For this reason, the manganese content is limited.

The reduced effect of the manganese with regard to controlling the structure is balanced out by means of adding zirconium. According to a preferred exemplary embodiment, the latter amounts to 0.14-0.20 wt. %. Zirconium also precipitates from the structure during homogenization of the extruded bars, in the form of zirconium aluminides. These aluminides are generally configured to be more micro-dispersed than the manganese aluminides. For this reason, they are particularly helpful with regard to controlling recrystallization. The zirconium aluminides that are formed are not made more coarse by the heat treatment that is provided, and are stable in the selected temperature ranges, in contrast to manganese aluminides. For this reason, zirconium is a necessary component of the alloy.

The titanium contained in the alloy primarily serves for making the grain fine during extrusion molding. A value of 0.03-0.1 wt. % titanium is preferred, particularly 0.03-0.06 wt. % titanium added to the alloy.

The desired properties are achieved if the alloy components are used in the proportions of the range indicated. Semi-finished products having the required properties can no longer be produced with an alloy in which one or more alloy components have a proportion that lies outside the range indicated.

The semi-finished products are produced from this alloy with the following steps:

Casting of bars of the alloy;

Homogenization or homogenizing of the cast bars at a temperature that lies as close as possible below the starting melt temperature of the alloy, for a heating and holding time that is sufficient to achieve as uniform and as fine a distribution of the alloy elements in the cast structure as possible, preferably at 460-490 degrees C.;

Hot forming of the homogenized bars by means of forging, extrusion and/or rolling, in the temperature range of 350-440 degrees C.;

Solution heat treating of the hot-formed semi-finished product at temperatures that are sufficiently high to bring the alloy elements necessary for hardening into solution uniformly distributed in the structure, preferably at 465-500 degrees C.; Quenching of the solution heat treated semi-finished products in water, at a temperature between room temperature and 100 degrees C., or in a water/glycol mixture, or in a salt mixture at temperatures between 100 degrees C. and 170 degrees C.; and Artificial aging of the quenched semi-finished product, in one stage or multiple stages, wherein the heating rates, holding times, and temperatures are adjusted for optimization of the properties.

There can be a method in which the artificial aging of the quenched semi-finished product occurs in two stages. In the first stage, the semi-finished product is heated to a temperature of more than 100 degrees C. and held at this temperature for more than eight hours, and in the second stage, it is heated to more than 130 degrees C. and heated for more than five hours. These two stages can be performed directly following one another. The semi-finished product treated with the first stage can also cool off, and the second stage of artificial aging can be performed at a later point in time, without having to accept any disadvantages with regard to the desired properties of the semi-finished product.

With greater thickness values, despite the non-sensitivity of the alloy to quenching, it may be necessary to subject the semi-finished product to a cold forming step after the step of quenching, to reduce the inherent stresses that occurred during quenching. It is practical if this occurs by means of upsetting or stretching of the semi-finished product by typically 1-5%.

BRIEF DESCRIPTION OF THE DRAWINGS

Other objects and features of the present invention will become apparent from the following detailed description considered in connection with the accompanying drawings, which disclose one embodiment of the present invention. It should be understood, however, that the drawings are designed for the purpose of illustration only and not as a definition of the limits of the invention.

In the drawings wherein similar reference characters denote similar elements throughout the several views.

DETAILED DESCRIPTION

Figure 1:
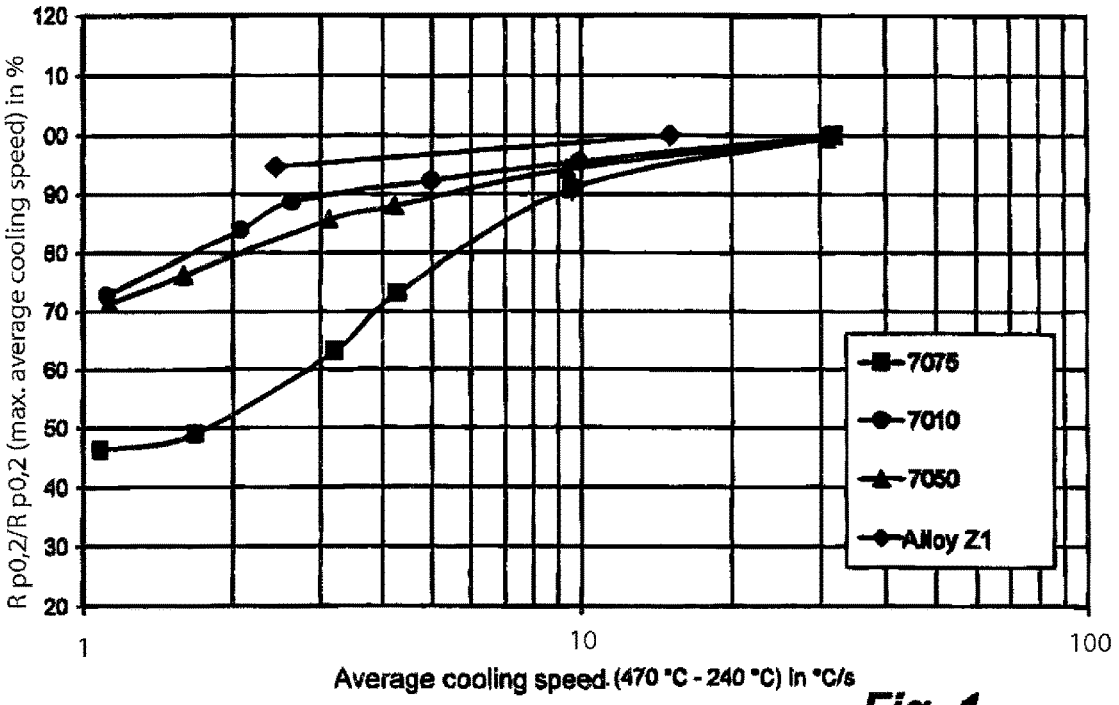
FIG. 1 is a graph representing the strength behavior of various AA 7xxx alloys as a function of the average cooling speed during quenching from solution heat treatment temperature.

The following are examples of different embodiments of the invention.

Examples

To produce sample pieces to carry out the required strength studies, two typical alloy compositions of the claimed aluminum alloy were produced. The two alloys Z1, Z2 have the following composition:

TABLE 1

| | Si | Fe | Cu | Mn | Mg | Cr | Zn | Ti | Zr | Ti + Zr |
|---|---|---|---|---|---|---|---|---|---|---|
| Alloy Z1 | 0.05 | 0.05 | 0.95 | 0.390 | 1.700 | 0.002 | 8.350 | 0.035 | 0.120 | 0.155 |
| Alloy Z2 | 0.04 | 0.07 | 0.90 | 0.004 | 1.650 | 0.001 | 8.500 | 0.025 | 0.120 | 0.145 |

The alloys Z1, Z2 were cast to produce extrusion blocks having a diameter of 370 mm, on an industrial scale. The extrusion blocks were homogenized to balance out the micro-segregation resulting from solidification. The blocks were homogenized in two stages, in a temperature range of 465 degrees C.-485 degrees C., and cooled.

Example 1

After the casting skin of the blocks produced in this manner had been lathed off, the homogenized blocks were pre-heated to 370 degrees C. and formed multiple times to produce free-form forged pieces having a thickness of 250 mm and to a width of 500 mm.

Subsequently, the free-form forged pieces of alloy Z1 and Z2 were solution heat treated at 485 degrees C. for at least 4 hours, quenched in water at room temperature, and subsequently artificially aged between 100 degrees C. and 160 degrees C., wherein the artificial aging was carried out in two stages. In the first stage, the semi-finished product was heated to more than 100 degrees C. and held at this temperature for more than eight hours. The second stage, which was carried out immediately after the first stage, took place at a temperature of more than 130 degrees C. for more than five hours.

Drawing samples were taken from the artificially aged free-form forged pieces, on which the strength properties at room temperature were determined in the sample positions "long" (L), "long-transverse" (LT), and "short-transverse" (ST). The average strength properties of the alloy Z1 and Z2 for a thickness of 250 mm with water quenching are shown in the following table:

TABLE 2

| Alloy | Stress Direction | $R_{p02}$ (MPa) | $R_M$ (MPa) | $A_5$ (%) |
|---|---|---|---|---|
| Z1 | L | 504 | 523 | 11.2 |
| Z1 | LT | 502 | 533 | 5.2 |
| Z1 | ST | 498 | 522 | 8.0 |
| Z2 | L | 520 | 528 | 8.6 |
| Z2 | LT | 508 | 530 | 4.0 |
| Z2 | ST | 511 | 525 | 5.1 |

The results show that the $R_{p02}$ and $R_{m_}$values are almost identical for all three stress directions, and lie above 490 MPa for the stretching limit ($R_{p02}$) and above 520 MPa for tensile strength. The $A_5$ values are highest for the L direction, and reach at least 4% breaking elongation ($A_5$) for the two transverse directions. The fracture resistance $K_{IC}$ of the sample positions L-T and T-L was determined using compact drawn samples (W=50 mm) from the same free-form forged pieces, according to ASTM-E 399. The $K_{IC}$ values are listed as follows:

| Alloy | Test Direction | Position | $K_{IC}$ (MPa$\sqrt{M}$) | $R_{P.02}$ (MPa) |
|---|---|---|---|---|
| Z1 | L-T | Edge | 30.5 | 529 |
| Z1 | L-T | Core | 32.9 | 504 |
| Z1 | T-L | Edge | 23.1 | 516 |
| Z1 | T-L | Core | 20.4 | 502 |
| Z2 | L-T | Edge | 30.3 | 514 |
| Z2 | L-T | Core | 35.9 | 520 |
| Z2 | T-L | Edge | 23.6 | 514 |
| Z2 | T-L | Core | 21.8 | 508 |

The stress crack corrosion resistance was determined on round samples for the LT and the ST position, according to ASTM G47 (alternating immersion test). The results are listed below for the alloy Z1:

| Stress Duration | Stress Mpa | Duration (Days) | Electrical Conductivity |
|---|---|---|---|
| LT | 320 | >30 | 34.7 |
| LT | 320 | >30 | 34.7 |

For both test directions, lifetimes of more than 30 days are obtained at stresses of 320 MPa. In typical specifications for high-strength Al alloys, such as for AA 7050, for example, these lifetimes are demanded at minimum stresses of 240 MPa. This means that-the new alloy, despite clearly greater strength as compared with the alloy AA 7050, at the same time has a stress crack corrosion resistance that clearly lies above the minimum value for AA 7050.

Analogously, forged pieces having the same parameters were produced from the alloy Z1. In addition, the forged pieces were cold-upset in the short transverse direction (ST) after solution heat treatment and quenching, to reduce the inherent stresses resulting from quenching. After the subsequent hardening, which was performed in two stages, in accordance with the parameters indicated above, the strength properties were determined at room temperature, in the sample positions "long" (L), "long-transverse" (LT), and "short-transverse" (ST). The results for the alloy Z1 are listed in the following table:

| Alloy | Stress Direction | $R_{p.02}$ (MPa) | $R_m$ (MPa) | $A_5$ (%) |
|---|---|---|---|---|
| Z1 | L | 504 | 523 | 11.2 |
| Z1 | LT | 502 | 533 | 5.2 |

-continued

| Alloy | Stress Direction | $R_{p.02}$ (MPa) | $R_m$ (MPa) | $A_5$ (%) |
|---|---|---|---|---|
| Z1 | ST | 498 | 522 | 8.0 |
| Z1 + Cold Upsetting | L | 448 | 501 | 11.1 |
| Z1 + Cold Upsetting | LT | 468 | 516 | 6.7 |
| Z1 + Cold Upsetting | ST | 417 | 498 | 10.8 |

The results show that the $R_{p02}$ and $R_m$ values for all three stress directions are less, and that the lowest value was found for the short-transverse direction (ST). The $A_5$ values are highest for the L direction, and reach-at least 6% breaking elongation $A_5$ for the two-transverse directions. The decrease in strength can be reduced by shortening the second hardening stage. The fracture strength $K_{IC}$ in sample positions L-T and T-L was determined according to ASTM-E 399, using compact drawn samples (W=50 mm) from the same free-form forged pieces. The $K_{IC}$ values are listed in the following table:

| Alloy | Test Direction | Position | $K_{IC}$ (MPa$\sqrt{M}$) | $R_{P.02}$ (MPa) |
|---|---|---|---|---|
| Z1 | L-T | Edge | 30.5 | 529 |
| Z1 | L-T | Core | 32.9 | 504 |
| Z1 | T-L | Edge | 23.1 | 516 |
| Z1 | T-L | Core | 20.4 | 502 |
| Z1 + Cold Upsetting | L-T | Edge | 38.9 | 485 |
| Z1 + Cold Upsetting | L-T | Core | 42.2 | 448 |
| Z1 + Cold Upsetting | T-L | Edge | 23.9 | 474 |
| Z1 + Cold Upsetting | T-L | Core | 21.9 | 468 |

Example 2

In another series of experiments, free-form forged pieces having a thickness of 150 mm and a width of 500 mm were produced from alloy Z1 and, after solution heat treatment, were quenched in water or a water/glycol mixture with approximately 20% and approximately 40%, respectively, and warm settled as described above. One forged piece was additionally cold upset after being quenched in water. The influence of the various cooling media was determined on drawn samples that were taken from the forged pieces in the directions "long" (L), "long-transverse" (LT), and "short-transverse" (ST). The average strength properties of the alloy for a thickness of 150 mm for various cooling treatments are shown as follows:

| Quenching Medium | Stress Direction | $R_{p.02}$ (MPa) | $R_m$ (MPa) | $A_5$ (%) |
|---|---|---|---|---|
| Water (RT) | L | 551 | 573 | 10.3 |
| Water (RT) | LT | 515 | 544 | 7.5 |
| Water (RT) | ST | 505 | 549 | 8.0 |
| Water (RT) + Cold Upsetting | L | 491 | 537 | 12.8 |
| Water (RT) + Cold Upsetting | LT | 465 | 520 | 8.7 |
| Water (RT) + Cold Upsetting | ST | 430 | 513 | 8.5 |
| Water/Glycol (16-20%) | L | 545 | 566 | 12.5 |

-continued

| Quenching Medium | Stress Direction | $R_{p.02}$ (MPa) | $R_m$ (MPa) | $A_5$ (%) |
|---|---|---|---|---|
| Water/Glycol (16-20%) | LT | 520 | 547 | 7.2 |
| Water/Glycol (16-20%) | ST | 512 | 548 | 8.3 |
| Water/Glycol (38-40%) | L | 503 | 529 | 12.2 |
| Water/Glycol (38-40%) | LT | 493 | 525 | 5.0 |
| Water/Glycol (38-40%) | ST | 487 | 526 | 5.6 |

The results show that a reduction in the cooling speed by adding glycol has hardly any influence on the strength properties of the alloy. The ductility decreases only minimally with a decreasing cooling speed, i.e. an increasing glycol content.

The fracture resistance $K_{IC}$ was determined in the sample positions L-T and T-L, according to ASTM-E 399, using compact drawn samples (W=50 mm) from the same free-form forged pieces. The $K_{IC}$ values are contained in the following table:

| QUENCHING MEDIUM | TEST DIRECTION | $K_{IC}$ (MPa$\sqrt{M}$) | $R_{P.02}$ (MPa) |
|---|---|---|---|
| WATER (RT) | L-T | 36.8 | 551 |
| WATER (RT) | T-L | 23.8 | 515 |
| WATER (RT) + COLD UPSETTING | L-T | 39.1 | 491 |
| ATER (RT) + COLD UPSETTING | T-L | 24.1 | 465 |
| WATER/GLYCOL (16-20%) | L-T | 28.2 | 545 |
| WATER/GLYCOL (16-20%) | T-L | 20.7 | 520 |
| WATER/GLYCOL (38-40%) | L-T | 35.4 | 503 |
| WATER/GLYCOL (38-40%) | T-L | 18.5 | 493 |

No clear dependence on the cooling speed is evident for the L-T position, but for the T-L position, a trend towards slightly lower values with decreasing cooling speed can be seen.

Example 3

To determine the strength properties, the alloy Z1 was also cast in another example, analogous to the first example, and blocks for extrusion were produced.

After the casting skin had been lathed off, the homogenized blocks were pre-heated to over 370 degrees C. and pressed into extrusion profiles having a rectangular cross-section, with a thickness of 40 mm and a width of 100 mm.

Subsequently, the profiles were solution heat treated for at least 4 hours at 485 degrees C., quenched in water at room temperature, and subsequently artificially aged between 100 degrees C. and 160 degrees C., in two stages (first stage: >100 degrees C., >8 h; second stage: >130 degrees C., >5 h).

Drawn samples were taken from the artificially aged extrusion profiles, on which the strength properties were determined at room temperature, in the sample positions "long" (L), "long-transverse" (LT), and "short-transverse" (ST). The average strength properties of the alloy Z1 for an extruded rectangular profile (40*100 mm) for water quenching with subsequent stretching are listed in the following table:

| STRESS DIRECTION | $R_{p.02}$ (MPa) | $R_m$ (MPa) | $A_5$ (%) |
|---|---|---|---|
| L | 600 | 609 | 9.3 |
| LT | 554 | 567 | 7.1 |
| ST | 505 | 561 | 7.5 |

The results show that the $R_{p02}$ and $R_m$ values are highest in the L direction, at values of 600 MPa and 609 MPa, respectively, and lowest in the ST direction, at values of 505 MPa and 561 MPa, respectively. The $A_5$ values are highest for the L direction, and reach at least 7% breaking elongation $A_5$ for the two transverse directions. The fracture resistance_ $K_{IC}$ in the sample positions L-T and T-L was determined according to ASTM-E 399, using compact drawn samples (W=50 mm) from the same free-form forged pieces. The average fracture mechanics properties of the alloy Z1 and Z2 for a thickness of 250 mm and water quenching are contained in the following table:

| Test Direction | $K_{IC}$ (MPa$\sqrt{M}$) | $R_{P.02}$ (MPa) |
|---|---|---|
| L-T | 50.9 | 50.9 |
| T-L | 30.7 | 30.7 |

FIG. 1 shows a diagram representing the strength behavior of various AA 7xxx alloys as a function of the average cooling speed during quenching from solution heat treatment temperature. It is clearly evident in this representation that the loss in strength when using the claimed aluminum alloy is significantly less, even at low cooling speeds, than in the case of the comparison alloys AA 7075, AA 7010, and AA 7050.

The strength values of the products/semi-finished products produced with the claimed alloy, determined within the scope of the description of the invention, are significantly improved, in particular with regard to stress crack corrosion resistance, as compared with products of previously known alloys, which represents a result that was not foreseeable in the form that occurred. The results shown are also interesting in that the strength values described can be particularly presented with artificial aging that is carried out in only two stages.

Figure 2:
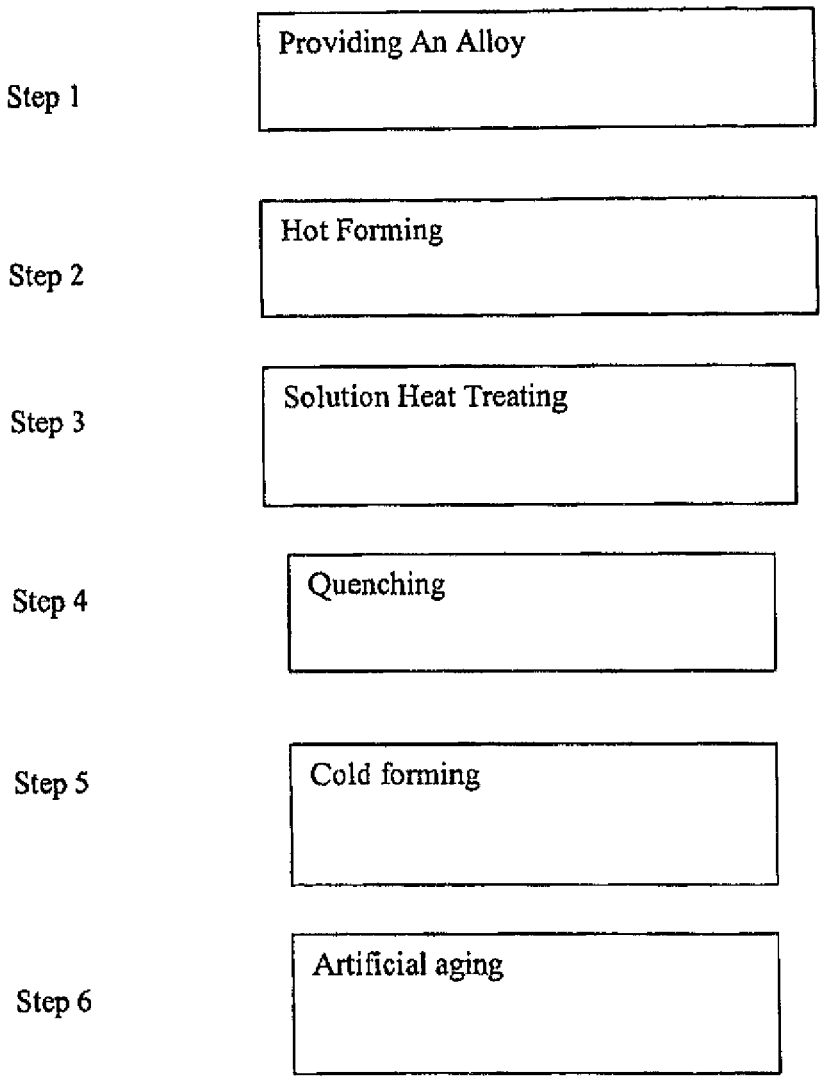
FIG. 2 is a flow chart for a process for producing the alloy.

FIG. 2 shows a flow chart for a process for producing the alloy. For example, step 1 comprises providing the alloy which is disclosed in the above examples. In step 2, the alloy is hot formed as described above, and in step 3, the alloy is solution heat treated as described above. In step 4, the alloy is quenched, while in step 5, the alloy is optionally cold formed, while in step 6, the alloy is artificially aged as described above.

Accordingly, while a few embodiments of the present invention have been shown and described, it is to be understood that many changes and modifications may be made thereunto without departing from the spirit and scope of the invention as defined in the appended claims.

What is claimed:

1. A aluminum alloy semi-finished product manufactured from an aluminum alloy that is not sensitive to quenching, the product having a thickness of at least 100 mm said product being manufactured from an aluminum alloy with the following chemical composition comprising:

7.0-10.5 wt. % zinc;

0.06-0.25 wt. % zirconium;

1.0-2.5 wt. % magnesium;

0.1-1.15 wt % copper;

0.02-0.15 wt. % titanium;
0.05-0.4 wt. % manganese;
0.001-0.03 wt. % boron;
between 0.2 wt % and 0.6 wt. % silver;
at most 0.10 wt. % silicon;
at most 0.10 wt. % iron;
at most 0.04 wt. % chromium;
a plurality of contaminants at proportions of at most 0.05 wt. % per element with a total contaminant proportion of at most 0.15 wt. %;
wherein a remaining amount by wt % is aluminum;
wherein a sum of the alloy elements zinc and magnesium and copper is at least 9 wt. %;
wherein the amount of zinc and magnesium is in the form of a zinc:magnesium ratio that is between 4.4 and 5.3; and
which product has been quenched after a solution heat treatment, by which quenching the product has lost less strength than alloys AA7010, AA7050, or AA7075 during the same process.

2. A aluminum alloy semi-finished product manufactured from an aluminum alloy that is not sensitive to quenching,
the product having a thickness of at least 150 mm said product being manufactured from an aluminum alloy with the following chemical composition comprising:
7.0-10.5 wt. % zinc;
0.06-0.25 wt. % zirconium;
1.0-2.5 wt. % magnesium;
0.1-1.15 wt % copper;
0.02-0.15 wt. % titanium;
0.05-0.4 wt. % manganese;
0.001-0.03 wt. % boron-
between 0.2 wt % and 0.6 wt. % silver;
at most 0.10 wt. % silicon;
at most 0.10 wt. % iron;
at most 0.04 wt. % chromium;
a plurality of contaminants at proportions of at most 0.05 wt. % per element with a total contaminant proportion of at most 0.15 wt. %;
wherein a remaining amount by wt % is aluminum;
wherein a sum of the alloy elements zinc and magnesium and copper is at least 9 wt. %;
wherein the amount of zinc and magnesium is in the form of a zinc:magnesium ratio that is between 4.4 and 5.3; and
which product has been quenched after a solution heat treatment, by which quenching the product has lost less strength during quenching than alloys AA7010, AA7050, or AA7075 during the same process.

3. The product according to claim 2, wherein the alloy further comprises one or more elements selected from the group consisting of: hafnium, scandium, strontium and vanadium with a summary content of at most 1.0 wt. % and 0.2-0.6 wt % silver.

4. The product according to claim 2, wherein the alloy further comprises 0.001-0.03 percent by weight boron, and wherein said silver is between 0.2-0.4 wt %.

5. The product according to claim 2, wherein the alloy further comprises a maximum of 0.2 percent by weight cerium and a maximum of 0.30 percent by weight scandium.

6. The product according to claim 2, wherein the alloy further comprises a maximum of 0.2 percent by weight cerium.

7. The product according to claim 2, wherein the alloy contains 1.6 to 1.8 wt. % magnesium and 0.8 to 1.1 wt. % copper.

8. The product according to claim 2, wherein the alloy contains 0.8 to 1.1 wt. % copper and 0.3 to 0.4 wt. % manganese.

9. The product according to claim 2, wherein the alloy contains 0.8 to 1.1 wt. % copper.

10. The product according to claim 2, wherein the alloy contains 0.25 to 0.40 wt. % silver.

11. The product according to claim 2, wherein the alloy contains 0.10 to 0.15 wt. % titanium.

12. The product as in claim 2, wherein the iron and silicon content is at most 0.08 wt. %, in each instance.

13. An aluminum alloy semi-finished product configured to be formed as an airplane part having been manufactured by forging, extruding, or rolling, the product being manufactured from an aluminum alloy that is not sensitive to quenching,
the product having a thickness of at least 150 mm said product being manufactured from an aluminum alloy has the following chemical composition comprising:
7.0-10.5 wt. % zinc;
0.06-0.25 wt. % zirconium;
1.0-2.5 wt. % magnesium;
0.1-1.15 wt % copper;
0.02-0.15 wt. % titanium;
0.05-0.4 wt. % manganese;
0.001-0.03 wt. % boron-
between 0.2 wt % and 0.6 wt. % silver;
at most 0.10 wt. % silicon;
at most 0.10 wt. % iron;
at most 0.04 wt. % chromium;
a plurality of contaminants at proportions of at most 0.05 wt. % per element with a total contaminant proportion of at most 0.15 wt %;
wherein the remaining amount by wt % is aluminum;
wherein the sum of the alloy elements zinc and magnesium and copper is at least 9 wt. %;
wherein the amount of zinc and magnesium is in the form of a zinc:magnesium ratio that is between 4.4 and 5.3; and
which product has been quenched after a solution heat treatment, by which quenching the product has lost less strength than alloys AA7010, AA7050, or AA7075 during the same process.

14. The product according to claim 12, wherein the alloy further comprises one or more elements selected from the group consisting of: hafnium, scandium, strontium and vanadium with a summary content of at most 1.0 wt. %, and also 0.2-0.7 wt % silver.

15. The product according to claim 13, wherein the alloy further comprises 0.001-0.03 percent by weight boron and wherein said silver is between 0.2-0.4 wt %.

16. The product according to claim 13, wherein the alloy further comprises a maximum of 0.2 percent by weight cerium and a maximum of 0.30 percent by weight scandium.

17. The product according to claim 13, wherein the alloy further comprises a maximum of 0.2 percent by weight cerium.

18. The product as in claim 13, wherein the alloy contains 0.001 to 0.03 wt. % boron.

* * * * *